US008880323B2

(12) United States Patent
Jain et al.

(10) Patent No.: US 8,880,323 B2
(45) Date of Patent: Nov. 4, 2014

(54) COMBINING ROAD AND VEHICLE TRAFFIC INFORMATION

(75) Inventors: Ravi Jain, Palo Alto, CA (US); Samir Goel, San Francisco, CA (US); Gregory Neverov, Seattle, WA (US)

(73) Assignee: Google Inc., Mountain View, CA (US)

( * ) Notice: Subject to any disclaimer, the term of this patent is extended or adjusted under 35 U.S.C. 154(b) by 838 days.

(21) Appl. No.: 12/673,759

(22) PCT Filed: Aug. 15, 2008

(86) PCT No.: PCT/US2008/073340

§ 371 (c)(1),
(2), (4) Date: Jun. 17, 2010

(87) PCT Pub. No.: WO2009/026161

PCT Pub. Date: Feb. 26, 2009

(65) Prior Publication Data

US 2010/0286899 A1 Nov. 11, 2010

Related U.S. Application Data

(60) Provisional application No. 60/956,320, filed on Aug. 16, 2007.

(51) Int. Cl.

| | |
|---|---|
| ***G08G 1/00*** | (2006.01) |
| ***G08G 1/01*** | (2006.01) |
| ***G08G 1/127*** | (2006.01) |

(52) U.S. Cl.

CPC ..... *G08G 1/0104* (2013.01); *G08G 1/127* (2013.01)

USPC ..... 701/119; 701/117; 701/200; 702/6; 706/11; 707/10; 714/40

(58) Field of Classification Search

USPC ..... 701/117, 200; 702/6; 706/11; 707/10; 714/40

See application file for complete search history.

(56) References Cited

U.S. PATENT DOCUMENTS

| | | | | |
|---|---|---|---|---|
| 6,329,932 | B1 | 12/2001 | Fastenrath | |
| 2004/0083057 | A1 * | 4/2004 | Trost et al. | 702/6 |
| 2006/0064233 | A1 * | 3/2006 | Adachi et al. | 701/117 |
| 2007/0005609 | A1 * | 1/2007 | Breed | 707/10 |
| 2007/0185643 | A1 | 8/2007 | Yamane et al. | |
| 2007/0208493 | A1 * | 9/2007 | Downs et al. | 701/117 |
| 2007/0208494 | A1 * | 9/2007 | Chapman et al. | 701/117 |
| 2008/0244326 | A1 * | 10/2008 | Basu | 714/40 |
| 2009/0138415 | A1 * | 5/2009 | Lancaster | 706/11 |
| 2010/0076675 | A1 * | 3/2010 | Barth et al. | 701/200 |

OTHER PUBLICATIONS

Lianyu Chu et al., "Adaptive Kalman Filter Based Freeway Travel Time Estimation," Submitted to 2005 TRB Annual Meeting.

Pravinva Raiya, "What We've Learned About Highway Congestion," Access No. 27, Fall 2005.

(Continued)

*Primary Examiner* — James Trammell
*Assistant Examiner* — Sanjeev Malhotra
(74) *Attorney, Agent, or Firm* — Fish & Richardson P.C.

(57) ABSTRACT

A computer-implemented method includes obtaining road sensor data reflecting speeds of traffic on road segments, transforming the road sensor data using vehicle probe data for the road segments reflecting vehicle speeds, and producing speed estimates for the road segments using the transformed road sensor data. The method can further include determining speeds for road segments between road sensors by smoothing data from sensors near the road segments.

20 Claims, 11 Drawing Sheets

(56) References Cited

OTHER PUBLICATIONS

Chao Chen et al. "Systematic Identification of Freeway Bottlenecks" 83rd Ann. Mtg. Transportation Research Board, Washington, DC, Jan. 2004.

Payne, H.J. et al. "Development and Testing of Incident Detection Algorithms" FHWA-RD-76-20, Federal Highway Administration, Washington DC 1976.

Action issued in European Patent Application 08797992.8 on Dec. 28, 2010.

* cited by examiner

600

602

COMBINING ROAD AND VEHICLE TRAFFIC INFORMATION

CROSS-REFERENCE TO RELATED APPLICATIONS

This document claims priority to U.S. Application Ser. No. 60/956,320 filed on Aug. 16, 2007, by Jain et al., and entitled "Combining Road and Vehicle Sensor Traffic Information," the contents of which are herein incorporated by reference in their entirety.

TECHNICAL FIELD

This disclosure relates to management and use of traffic flow information.

BACKGROUND

Highway traffic speed determination or estimation is important. Speed estimation is often used to determine where and how to deploy limited transportation funding, i.e., so that the busiest (or most congested) roads receive the most attention. Speed estimation can also be used to provide more timely information, such as providing near real-time traffic information to drivers so that they or their navigation systems may determine a best path between two points. Such traffic speed information can be displayed to a user, for example, as colors overlaid on a map of a roadway system on a navigation device. Such use of traffic information can save on time, aggravation, vehicle wear, and fuel usage.

Traffic speed estimation may be based on speed readings provided by sensors, such as in-road sensors operated by a state highway department or department of motor vehicles. Traffic speed estimation may also be based on probe vehicles, e.g., moving cars provided with location-sensing technology such as GPS, that can report in on their locations and speeds.

SUMMARY

This document discusses systems and techniques that may be used to provide improved traffic flow information, such as estimates of traffic speed at various locations in a system of roadways. While road sensors provide relatively complete coverage, some evidence appears to indicate that road sensors may be less accurate than are probe sensors due to noise and errors in the data they provide. In contrast, although probe sensors tend to have less complete coverage than do road sensors (which have been purposefully located at particular locations of interest) and also provide data only from the viewpoint of a single vehicle, they may provide more accuracy and they may provide coverage for areas that are never covered by road sensors (because vehicle probes move around while road sensors generally do not). The description below discusses acquiring sensor data and cleaning it using probe data, such as by a Bayesian linear regression approach. The coverage of the sensors is then extended by inferring inter-sensor location speeds using smoothed values from nearby sensors. The weights to be provided in conducting the smoothing may be assigned from learning via a training data set.

In a more general sense, data (e.g., from vehicle probes) that is not comprehensive enough to provide satisfactory results by itself, may be used to improve the quality of other data (e.g., from road sensors) that has coverage that is sufficiently comprehensive, but is of a lower quality. The improvement in the data from the more comprehensive sensors may occur by computing a transform that needs to be applied to a particular sensor or sensors (and perhaps at a particular time) to make the sensor better correspond to data form the less-comprehensive but more accurate sensors, when and where such data is available. Such a transform may then be applied to future readings received from such sensors to make the future readings more accurate. In addition, the resulting data may also be smoothed so as to better reflect the reality of traffic flow. Such smoothing may occur, for example, by machine learning techniques.

Such approaches may, in certain implementations, provide one or more advantages. For example, combining data from different types of traffic sensors may result in significant improvements in coverage for traffic data. In particular, data may be obtained for areas in which a highway department has not chosen to install relatively expensive sensors in the road. In addition, such a system may also provide more accurate data with improved coverage, particularly when traffic is congested. As a result, users may be provided with better data in helping them, or their navigation systems, to plot a best route between two points. And makers of navigation devices may benefit by being able to provide more accurate information to their customers, thus obtaining an important marketing advantage over makers of less accurate systems. Information providers may also benefit, as additional use of certain devices may cause users to demand more information, and thus allow information providers to derive revenue from sources such as targeted advertising.

In one implementation, a computer-implemented method is disclosed, that comprises obtaining road sensor data reflecting speeds of traffic on road segments, transforming the road sensor data using vehicle probe data for the road segments reflecting vehicle speeds, and producing speed estimates for the road segments using the transformed road sensor data. Obtaining the road sensor data can comprise combining road sensor data from a plurality of data providers. Also, transforming the road sensor data can comprise cleaning the road sensor data using Bayesian linear regression against the probe data. The vehicle probe data used to transform the road sensor data can be matched in time and location to the road sensor data.

In certain aspects, the method can further comprise determining speeds for road segments between road sensors by smoothing data from sensors near the road segments. In addition, the speeds for road segments between road sensors can be determined using machine learning from training data.

In another implementation, a computer-implemented method comprises obtaining traffic speed data from a first type of traffic sensors and a different, second type of traffic sensors, transforming the traffic speed data from the first type of traffic speed sensors using the traffic speed data from the second type of traffic speed sensors, and producing speed estimates for the road segments using the transformed traffic speed data. The first type of traffic sensor can have superior coverage but inferior accuracy, and the second type of traffic sensor can have inferior coverage but superior accuracy.

In yet another implementation, a computer-implemented system includes computer memory holding road sensor data reflecting speeds of traffic on road segments, computer memory holding vehicle probe data, and a processor programmed to transform the road sensor data via comparison with the vehicle probe data.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
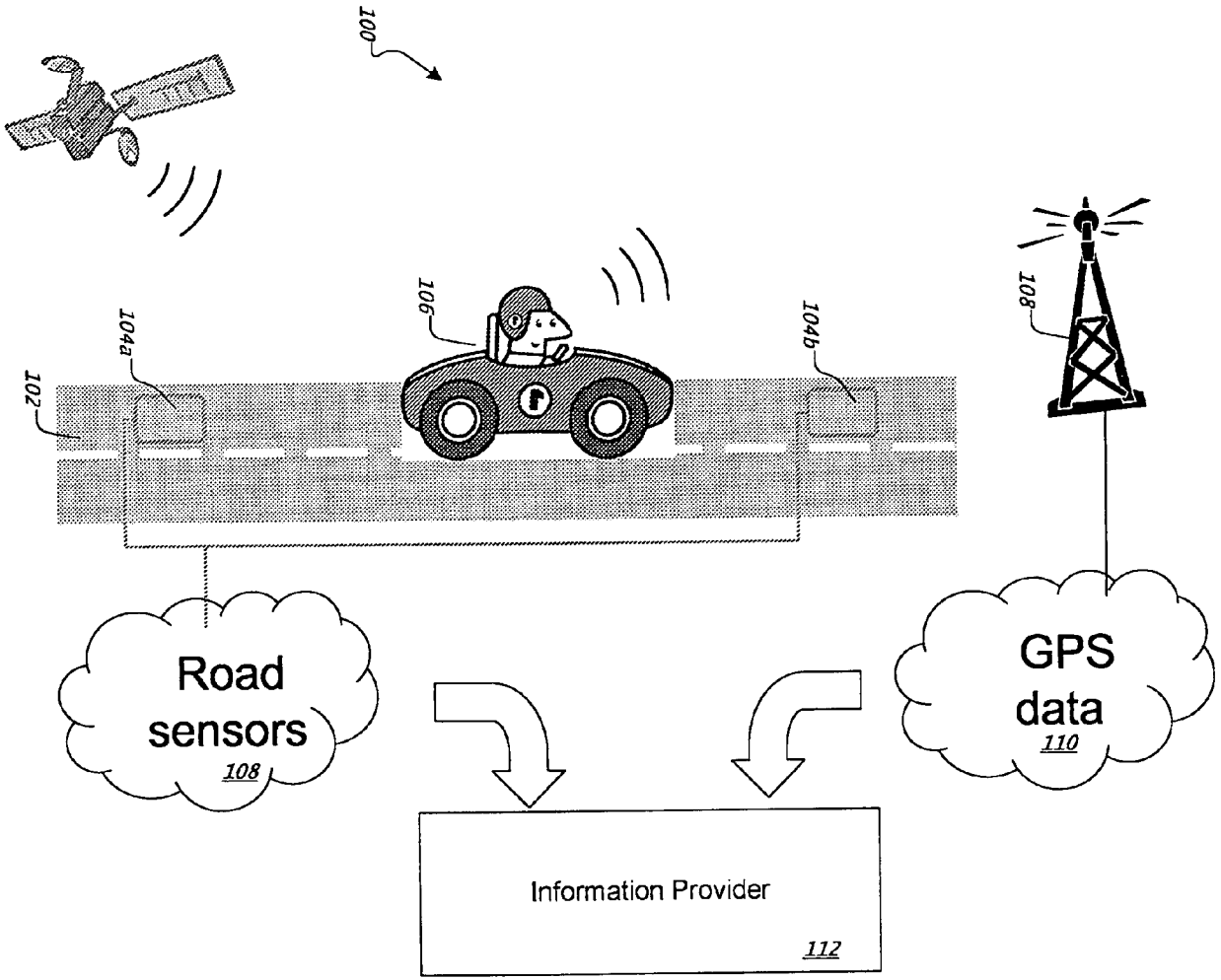
FIG. 1 shows an environment for the collection of traffic information.

FIG. 1 shows an environment 100 for the collection of traffic information. The environment 100 generally shows mechanisms for collecting data regarding traffic, such as the speed of traffic in particular locations along a road or roads. In the figure, a road segment 102 is shown on which a vehicle 106, in this example a small sports car, is driving from left to right. The vehicle may be any sort of vehicle that uses a roadway, such as a car, truck, motorcycle, or other such vehicle, and may be owned and operated by an individual or a larger organization.

Road sensors 104*a*, 104*b*, such as single loop sensors, or other appropriate forms of road sensors, may sense the speed of the vehicle 106 as it passes over them. Road sensors 104*a*, 104*b* may also sense the speed of other vehicles when they pass over, and may thus provide some level of information for the average (across multiple vehicles) instantaneous speed of vehicles that pass over them.

The road sensors 104*a*, 104*b* may be in communication with a central data processing system 108 for an entity such as a department of transportation. The department of transportation or other such organization may continually monitor various road sensors scattered throughout a metro area, including by obtaining and storing time and speed paired data for each sensor in an area. The entity may make such data available, in real time or in later batch downloads, to various requesters of the data, such as information providers that show real-time traffic information to their users or subscribers. Alternatively, or in addition, the central data processing system 108 may receive traffic information from other sensors, such as by monitoring traffic flow in video taken by roadside traffic cameras.

Information provider 112 may be one of a variety of organizations that provide traffic information to users and prospective users of roads in an area. Information provider 112 may include, for example, companies that provide traffic speed data for viewing on mobile devices of various users, such as mobile smart phones and automotive navigation devices. Information provider 112 may also provide a number of other services in addition to traffic data. For example, information provider 112 may provide local search result information to users, such as information about restaurants, gas stations, or other venues of interest to users of the information provider 112. In addition, the information provider 112 may provide promotional information, such as advertisements, along with other provided information, to assist the information provider 112 in earning enough profit that it may continue providing such information to users at a reduced or zero price.

Information provider 112 may also obtain traffic information from types of sensors other than road sensors. For example, vehicles may be outfitted with communications systems, which may include navigation systems, that use global positioning system (GPS) technology to determine a location for a particular vehicle. Alternatively, a smart phone or other mobile device carried by a user may also include GPS capability, and thus be able to determine its location, and by extension, the location of a user's vehicle. Such devices may transmit information relating to the determined location, such as latitude/longitude information, to a remote computer where it may be analyzed and used to provide a user with a variety of services. For example, the location information may be used to better target search results or advertisements to the user, so that the user is shown results associated with the area around the user's current location.

In this example, the user data is shown as being broadcast to a communication tower 108 connected to a computer system 110, which may take a variety of forms. For example, devices may be mounted in vehicles to sense and report GPS coordinates of the vehicles, or drivers of vehicles may carry devices, such as smartphones or PDAs that may include similar functionality. Such information may assist individuals in receiving personalized information, such as local search results and other targeted information, and may assist organizations that run fleets of vehicles in tracking and deployment of the vehicles, and for other purposes. As described here, such location information may also be used in generating a more accurate picture of traffic flows in a roadway system.

For example, such location information may be passed by computer system 110 to information provider 112, and may be used in combination with information received from central data processing system 108. In one example, a distance between two GPS readings from vehicle 106 may be divided by the time between the readings to determine an average speed for the vehicle during that time. Such a determination may be made at the vehicle 106 itself, by central data processing system 110, or by information provider 112.

Although collection of vehicle probe data is shown in this example as occurring by particular organizations such as one running central data processing system 110 (e.g., a department of transportation), such collection may occur by many other mechanisms also. For example, an organization that provides information to navigation systems may collect such information from its associated navigation systems, and may provide it to information provider 112. Each of those two organizations may also be the same organization. In addition, location information for portable devices that are not always associated with a vehicle, such as a user's portable cellular telephone, may also provide information about location, such as to a cellular telephone network provider. That provider may then organize and forward such data to information provider 112. Data associated with roadway travel may be extracted for the uses described here.

Figure 2:
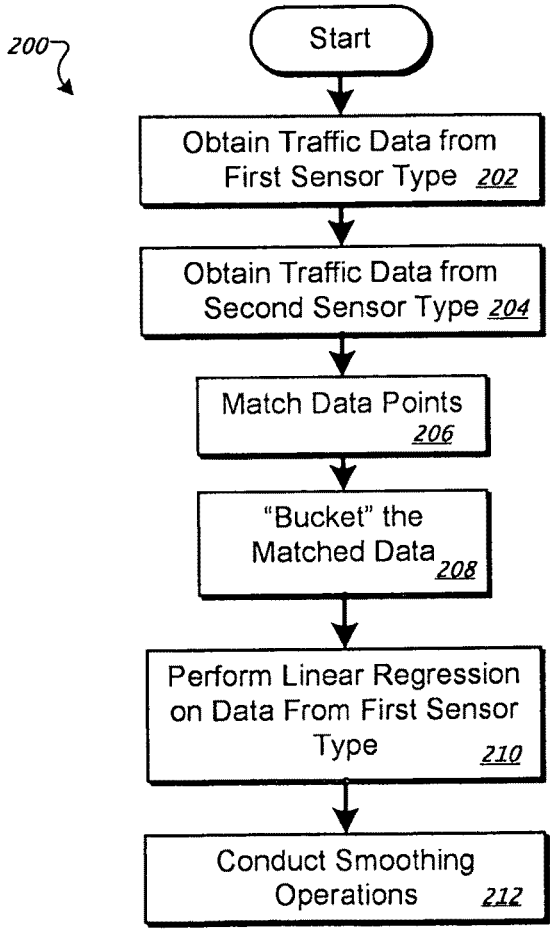
FIG. 2 is a flowchart of a process for combining and using traffic information.

FIG. 2 is a flowchart of a process 200 for combining and using traffic information. In general, the process 200 involves obtaining traffic data, and in more particularity, data about the speed of traffic at particular locations, from multiple types of sensors; matching up data from the various sensors to correspond in location and time; and using data from one of the types of sensors to improve the readings from the other type of sensors. For example, road sensors may produce speed data that is inaccurate, and the vehicle probe data may be used to correct the inaccuracies in the road sensor data, even where the vehicle probe data is insufficient in quantity to provide useful information by itself.

At box 202, traffic data from a first sensor type is obtained. Such data may be received from a commercial service provider, or a government organization, such as in the form of real time road sensor data. Such data may be received by, and formatted in, well known manners, as agreed to by the sending and receiving organizations. The data may represent a large plurality of data points for a large plurality of sensors.

At box 204, traffic data from a second sensor type is obtained. The second sensor type is substantively different from the first sensor type, so as to provide qualitatively different data for similar readings. For example, one sensor type may generally provide higher speed readings in a particular road segment at a particular time, than will another type of sensor. Because the readings from the different sensors differ, one or both of the sensors may be inaccurate, and the information from the other type of sensor may be used to make the speed data from the first type of sensor more accurate.

At box 206, various received data points are matched. In particular, each data point received from the various sources may be provided with a timestamp and location indicator. For example, readings from a particular road sensor may have a common location ID, whereas a location for a vehicle probe may be determined from GPS readings received by the probe. In this step, the various data points are matched as well as possible so that corresponding instances of vehicle traffic may be matched between the sensor types. The particular values for times and locations may be loosened somewhat to prevent false negatives from preventing a match where a match actually exists. In addition, clocks between two systems may be coordinated, and time values for one of the systems may be adjusted accordingly so as to match with the values for the other system.

Such coordination may be used to produce a paired datum for each location and time. The process for identifying paired datums may take the following form. A system may first identify a particular sensor or a road segment associated with a particular sensor. The system may then identify every vehicle probe reading across the sensor or segment, and may compute the time and the speed at which the crossing occurred. The system may then attempt to identify a reading from the sensor from about the same time as a vehicle crossing (e.g., within 10 minutes or less). If a match is identified, a paired datum may be created having the speed from the road sensor, the speed from the vehicle probe, and a timestamp of the probe vehicle crossing time. If multiple probes cross the segment at about the same time as a single sensor reading, multiple pairings may be generated for the one sensor reading.

At box 208, these various data points are classified into discrete buckets for analysis. For example, the paired data for a sensor that is to be adjusted may be identified for the sensor or the road segment near the sensor. A number of time windows of data may then be formed, for example, centered on 15-minute increments, where the windows are, say, 45 minutes wide. For example, a first window may be centered at 8 a.m., with its sides at 22½ minutes on each side of 8 a.m. The next window may be centered on 8:15 a.m., again with the sides 22½ minutes from the center. The data falling within the time periods for each of these windows may be considered to fall in common buckets for purposes of analysis. Other parameters for grouping data to make the analysis easier may also be used, and different time parameters may also be employed. Because the windows in this example are wider than the time between window centers, certain paired data may appear in multiple buckets.

At box 210, linear regression analysis is performed on the data, to determine a transform that may be applied to the one type of data to make it more accurate. For example speed values for the sensor may be treated as an input variable, and vehicle probe speed for corresponding times or buckets may be used as the output variable. Bayesian linear regression may be used with a prior favoring a solution of "probe_speed=sensor_speed+0." Such an arrangement assumes that a road sensor is accurate until it is established to be inaccurate. In this example, an accurate sensor would have no correction, i.e., y=x. By using a strong prior solution, a lot of data will be needed to provide confidence in choosing a correction function that is different from y=x. As a result, if there is little paired data for a sensor, the readings for the sensor will not be affected much by this process. The maximum likelihood of the posterior is used to adjust incoming sensor data that occurred closest to the center point of a window for a bucket. A separate regression may be performed in this example for each of the buckets over the course of a day.

The linear regression may be used and then to adjust future readings received from the analyzed sensors. In particular, the result of the linear regression may be used to develop a transform or transforms for the analyzed sensor. These transforms may be applied to future readings from the sensors to, in effect, modify or "clean" those readings to provide more accurate traffic data. As one simple example, a faulty sensor whose readings tend to report speeds 0-10% lower than corresponding probe values would have a transform applied to its data which would increase the readings by that amount.

At box 212, smoothing operations are conducted to infer speeds between particular sensors. As one example, to calculate the road speed at a point in time and space, a weighted median of all sensor data may be computed. Most of the data may have a weight of zero or near zero because it is distant from the sensor of interest, and only data in the vicinity of the sensor of interest will have a weight that is appreciably more than zero. The weights to be provided to various sensors can be determined according to a function. One such function is the exponential kernel function, although other symmetric or asymmetric kernel or other functions could be used, such as a Guassian kernel function. For the example of the exponential kernel, if dx and dt are the differences in space and time, respectively, between a location corresponding to a query for traffic speed and data points corresponding to road sensors, then the weight may be expressed as $$W=\exp(-dx/kx)*\exp[(-dt/kt)$$

Possible values for kx include 800 meters and possible values for kt include 3 minutes. To improve efficiency, the process may compute radii rx and rt, at which the weight drops below a low threshold value (e.g., 0.01), so that only data within the computed region is gathered.

The smoothing operations may also be conducted according to a machine learning approach, such as by kernel learning. The idea of kernel learning is to learn an arbitrary kernel for a spatial factor. For example, the weighting function just discussed can be considered a product of a spatial weight and a temporal weight. The learned kernel is a matrix [w_ij], where i is an ID for a segment of road, j is an ID for a particular road sensor, and w_ij is how much weight to give to sensor j when calculating the speed at segment i.

Learning the value w_ij considers paired data from sensor j and probe vehicles at i. Initially, w_ij is set to a weight from the (unlearned) kernel. For the example of the exponential kernal, w0_ij=exp(−(i−l(j))/kx), where l(j) is the segment of sensor j. The amount of error, eps, between sensor j and segment i is computed as $$eps=(a*b+\mathrm{sum}(abs(s-p)))/(a+n).$$

The sum ranges over all relevant pair data, s and p, which are sensor and probe speeds of a pair respectively. Here, n is the number of paired data points. The a and b parameters are from prior estimates of the error so that the calculation is robust against few data with outliers. In particular, if there are no paired data points (n=0), setting b>0. One example setting for parameters is for a=20, b=15.

The learned value of w_ij is then set to w_ij=w0_ij*eps^(−p). The parameter p controls how much to prefer the locally-weighted exponential kernel and the error-weighted "learned" kernel; p=0 means no learning, i.e., w_ij=w0_ij, while p=infinity means total learning, i.e., w_ij=(j==argmin eps_j)?1: 0, i.e. the least-error sensor gets 100% weight, all other sensors get 0% weight. The learned weights are also normalized such that Sum(w_ij, j)=Sum(w0_ij, j). An example value for p is 30.

A group of certain metrics for testing the quality of the adjustments to sensor data may also be used. For example, all the paired data from a particular sensor at that sensor's road segment may be gathered and added to a global collection of paired data. A difference function may be applied to this collection to obtain a collection of error values. A measurement of global error may be determined by plotting a CDF (cumulative distribution function) of the error values or taking the median of the error values.

Another metric may provide an indication of the quality of coverage by data gathering devices. In this example, the speed of a probe vehicle may be interpolated at every segment on which the vehicle traveled during a particular trip. The smoothed sensor speed for each segment that the vehicle traveled on the same trip may also be computed. These computations may be used to form pairs of probe speed and smoothed sensor speed. Each of these pairs may be added to a global collection as one iterates over all vehicle trips. Applying a difference function to the collection may result in a collection of error values that can be plotted is a CDF of the error values, or whose median may be taken to give a measurement of global error.

The method just described uses a Bayesian linear regression approach to transform the data from the first type of sensors—here, road sensors—so as to adjust the values from those sensors for future traffic readings. Other approaches may also be employed in using data from one type of sensor (e.g., having inferior coverage but good accuracy) to correct data from another type of sensor (e.g., having superior coverage but possible inferior accuracy). Such approaches may include an Ordinary Least Squares (OLS) comparison, using covariance matrices in accordance with pattern recognition, and the like.

In certain implementations, a Bayesian approach may offer superior results. For example, some datasets take a form such as:

$$(x_i,y_i)=(p+x_\mathrm{noise}_i,p+y_\mathrm{noise}_i),$$

i.e., noise around a single point in 2D space. The OLS solution to this is y=p, which means the sensor that produced this dataset must be bad because there is no dependence on x. However, the solution y=x for a good sensor also has a high likelihood for this dataset. If one wants to assume that a sensor is good until there is sufficient evidence to say it is bad, there may not be enough evidence from this dataset to say it is bad because the data are not a wide enough selection from the domain of x (i.e., there is really only one value of x with input noise). So with a judiciously selected prior, one can obtain Bayesian regression to prefer false positives (the y=x solution, where "positive" means sensor is good) over false negatives (the y=p solution) when there is insufficient data.

Figure 3:
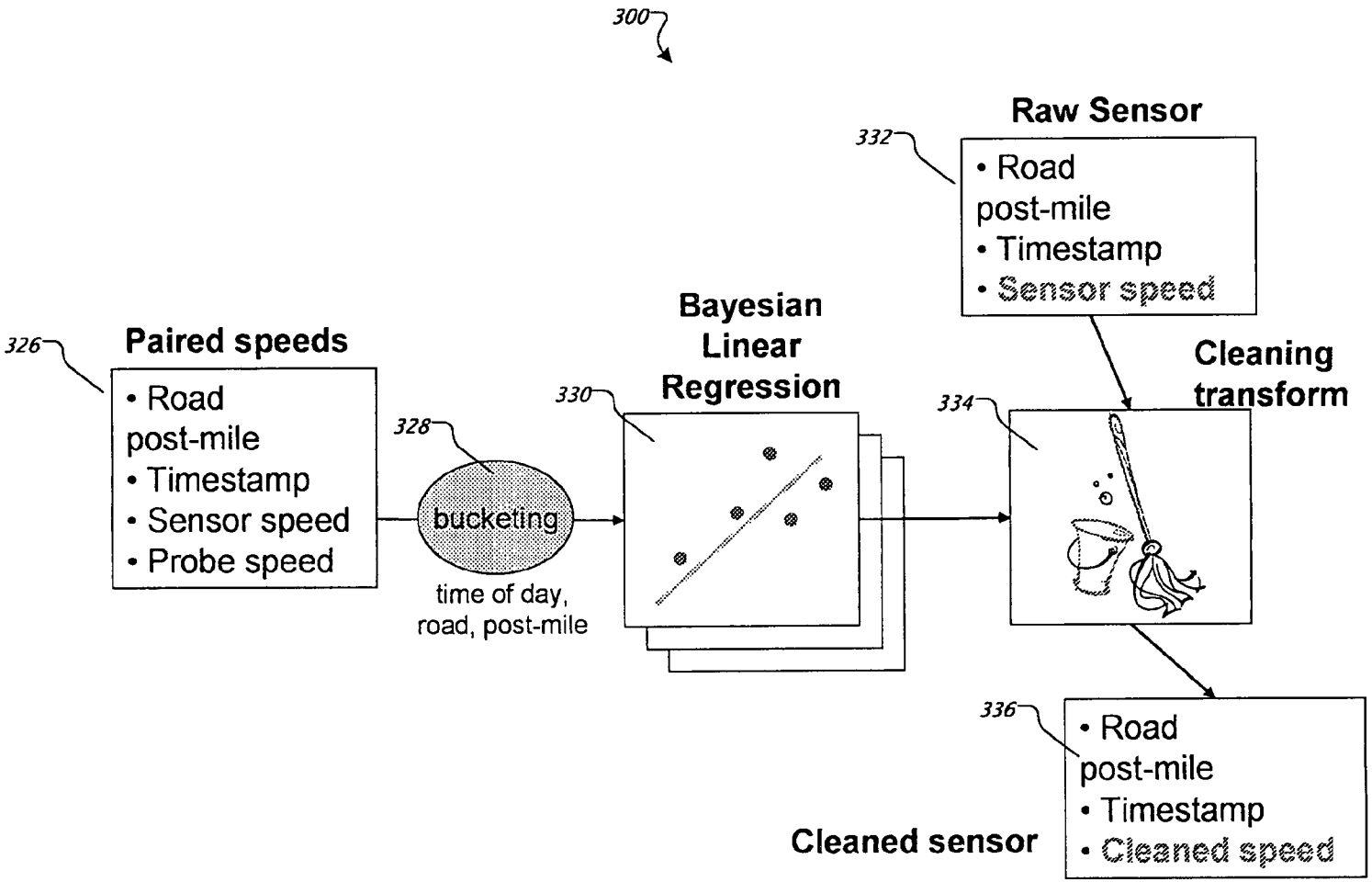
FIG. 3 shows a flowchart of a process for generating traffic speed information.

FIG. 3 shows a flowchart of a process 300 for generating traffic speed information. The process 300 generally shows processing of data from two different types of traffic sensors to provide improved traffic sensing data. In particular, the example in the figure shows cleaning of data from the first type of sensor, such as a sensor that has superior coverage as compared to the other type of sensor, but inferior accuracy as compared to the other type of sensor (e.g., because the first type of sensor is generally inaccurate, because that type of sensor has frequent failures, or because that type of sensor is not positioned or otherwise installed to obtain an accurate picture of traffic flow in the area of the sensor (e.g., the sensor is located at a point where sun reflects in drivers' eyes, so there is an uncharacteristic slowdown at the sensor but not around it)).

For cleaning of the data in the figure, paired speed data from two types of sensors that is paired for approximately the same location at approximately the same time, serves as an input to a cleaning process (item 326). Various data points may be further classified into groups, or buckets, according to their location and time. For example, several vehicles may have passed over a particular road sensor during a time frame of several minutes on a particular day, and certain multiple of those vehicles may have included devices reporting the position of the vehicles in a manner that the data from those devices were processed by the central tracking system. The readings from each of those devices, as paired with readings from corresponding road sensors, may then be placed in a common bucket to simplify the analysis of the traffic data. At item 330, data from the second type of sensor is applied to correct the readings from the first type of sensor. In this example, the particular transformation process for the data occurs by a Bayesian linear regression analysis of the two types of data.

Such transformation may then be used to modify future readings from the first type of sensor. Item 332 shows such future imports from a sensor such as a road sensor. Item 334 shows application of a transform to such data, with the transform being determined from the linear regression analysis in this example. Item 336 shows the output of the cleaning of the future data with an adjusted speed for traffic at a certain point in a roadway system.

Thus, by this process, certain types of sensors may have their future output adjusted in a manner that allows future observations by those sensors to be more accurate than the raw data from the sensors would otherwise allow. Such adjustment may come from other types of sensors that could not alone provide accurate future traffic data, such as because their coverage is not sufficient to provide a real-time snapshot of traffic flow.

Figure 4:
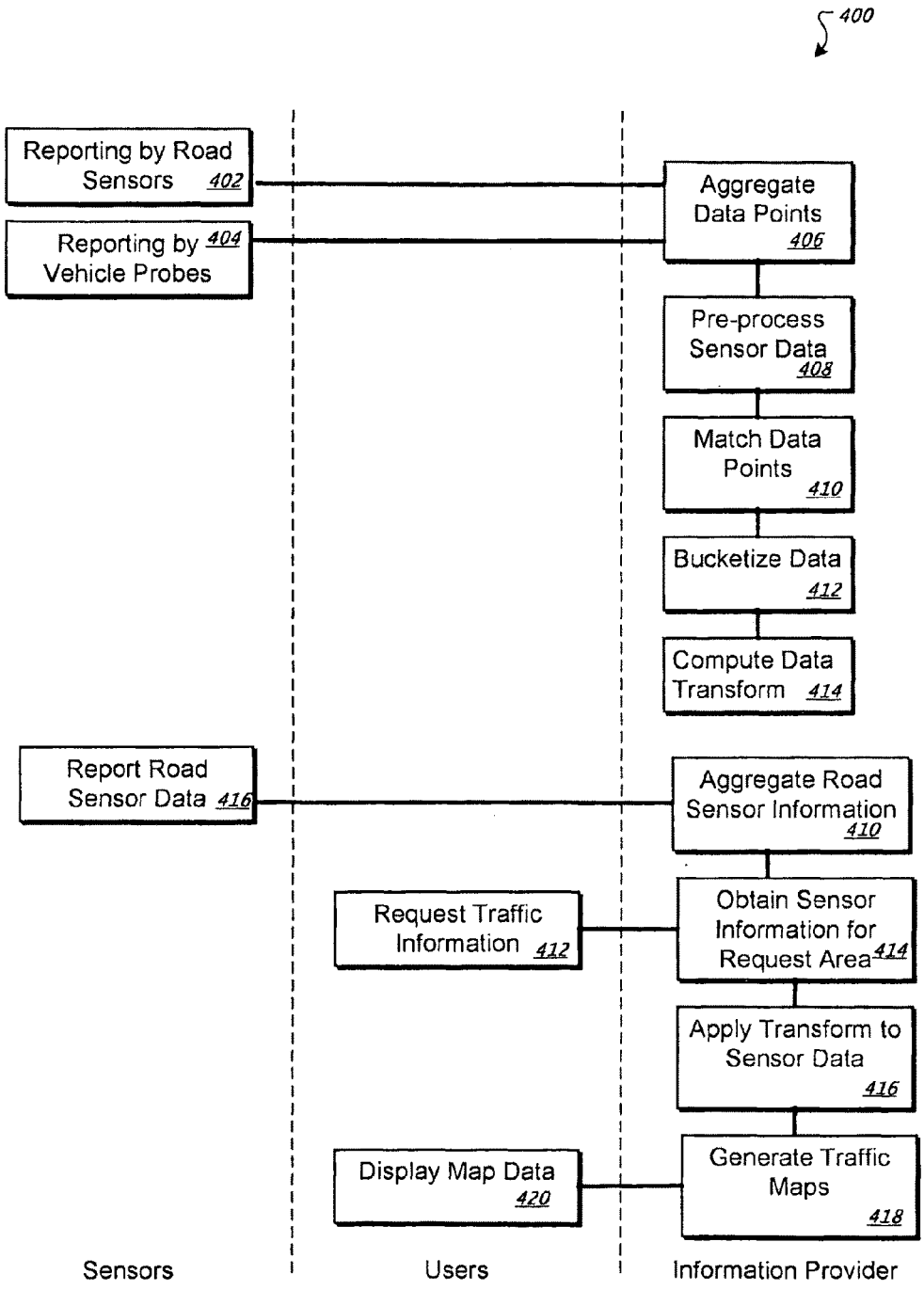
FIG. 4 is a swim lane diagram showing actions by various components in traffic tracking system.

FIG. 4 is a swim lane diagram showing actions by various components in a traffic tracking system. In general, the diagram shows collections of traffic information provided from various types of traffic sensors, processing of that data to improve the accuracy of the data from one or more of the types of sensors, and serving of responses to subsequent requests for traffic information, where the responses include the improvement to the data from the particular type of traffic sensors.

At box 402, readings from road sensors are reported, and at box 404, readings from vehicle probes are reported. As discussed above, such readings may include timestamps along with locations, sensed speeds, and other such information, depending on the type of sensor. At box 406, the information provider aggregates the data points produced by the various road sensors and vehicle probes. Such aggregation may occur at the information provider itself, or at an organization that provides information to the information provider. For example, a state highway department may aggregate road sensor information and make it available to third parties for analysis.

At box 408, the sensor data is preprocessed. For example, additional data may be generated from the sensor data, such as by adding geocoded locations for road sensors, and deriving vehicle speed between data points for probe vehicle sensors. Such modified sensor data may then be further reformatted so that all of the sensor data generally matches in format. At box 410, the various data points are matched, such as by identifying data points at or near a particular location, and at or near a common time such as in a window of time several minutes long. Broadening of the criteria for making a match may be necessary, because data points for vehicle probes may not be precisely on top of data for road sensors. The windows, both time-wise and spatially, for matching data points may be selected so as to provide a sufficient number of matching data points for analysis, but to not be so wide so as to envelop natural changes in the speed of traffic so that comparison of data points within a window would not provide an accurate view of real traffic.

At box 412, the data points are bucketized, in that multiple different data points in a particular area for a particular time range are joined together. Such a process may provide for additional data in the analysis process, and thus for a more accurate analysis. At box 414, a transform for the data is computed. Such a transform may be determined, for example, by a Bayesian linear regression analysis applied to the data from both types of sensors. The transform may represent the modification to data from one of the types of sensors that is needed to provide a more accurate reflection of actual traffic data that is not being captured by the raw sensor data alone.

After the transform has been computed, or multiple transforms for various roadways or portions of roadways have been computed, additional traffic data may come into the system. For example, at box 416, additional road sensor data is received regarding real-time or near real-time speeds for traffic flow in a system. The information provider may aggregate such road sensor information at box 410, so that it may be used to supply requesters with information that shows the requesters the current status of road traffic in an area. At box 412, a user requests traffic information, such as by the user's navigation system providing a request to a server at the information provider for such information. For example, the navigation device may display a roadmap of an area and may then seek to overlay colored lines or other indicators such as moving arrows, that graphically represent the speed of traffic on various road segments on the map.

Upon receiving the request for traffic information, the information provider may obtain stored sensor information from a recent period for an area requested by the user (box 414). Such data may be raw data from the sensors, and may therefore include inaccuracies inherent in the raw data. The information provider may then apply the transform computed at box 414 to the raw sensor data, at box 416. Such application of the transform may result in the data showing speeds of traffic for various road segments as being different from that shown by the raw data—and ideally more accurate.

At box 418, the information provider generates traffic maps or information for application to traffic maps indicative of speed on certain road segments. The information provider then transmits such information such as in the form of an XML file or other standard communication format, to a user device, and the user device displays the information at box 420, such as in the form of colored lines over particular road segments.

Figure 5:
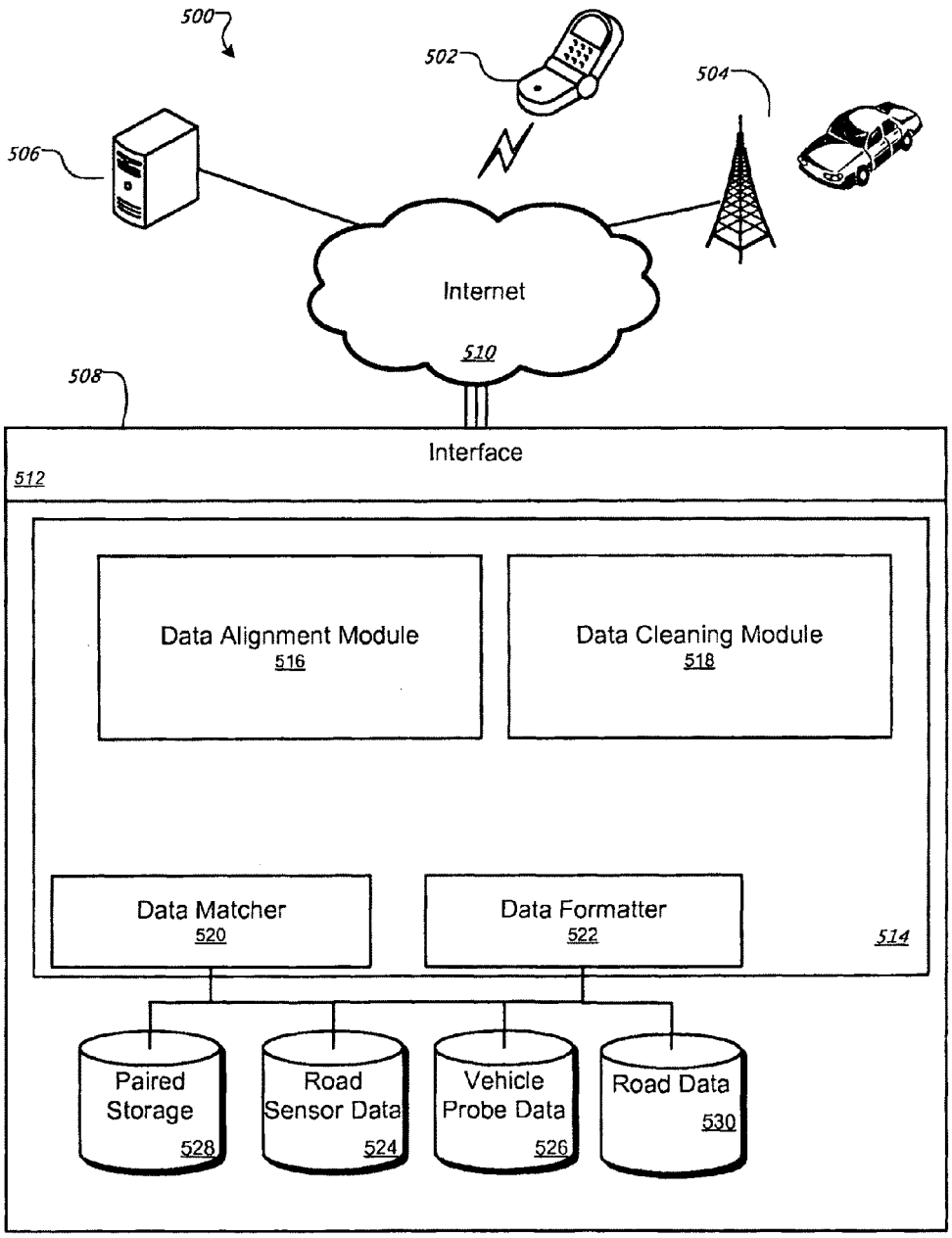
FIG. 5 is a schematic diagram of a system for providing traffic information.

FIG. 5 is a schematic diagram of a system 500 for providing traffic information. In general, the system 500 is directed toward providing various users with accurate real-time traffic information. The system 500 may be part of a much larger system such as a system operated by Google, which may provide many additional services to users, such as supplying search results, targeted advertising, shopping information, travel information, and many other various forms of information that is helpful to users. The system 500 generally includes a main service provider system 508 that communicates with various remote devices through a network such as the Internet 510.

Examples of such devices with which communication occurs include a traffic data server 506. The traffic data server 506 may be operated by an organization, such as a governmental organization, that manages road sensors and gathers data from such road sensors. The information provider system 508 may make requests of the traffic data server 506, to obtain both historical and real-time information about traffic speeds and other traffic information obtained from the road sensors. Other devices may communicate with information provider system 508 to either provide information to or receive information from information provider system 508. For example, mobile device 502 may make requests of information provider system 508, to see maps of real-time traffic information for a particular area. The mobile device may, in turn, be used by information provider system 508 to infer that the user is traveling in a car along a particular roadway, and by extension to use the location of the device as a mechanism for determining traffic speed on the roadway. In a similar manner, vehicle 504 may make requests for information, and also may provide location information that may be used by information provider system 508.

An interface 512 on information provider system 508 may perform various operations for receiving requests and data through Internet 510, and for providing information to remote devices through Internet 510. The interface 512 may include, for example, one or more web servers and other associated servers for formatting and interpreting transmissions over the network.

The information provider system 508 may store a variety of forms of data for the purpose of providing traffic information. For example, road sensor data 524 may be stored to provide information about past and current traffic flow over particular road sensors in a network of roads. In a similar manner, vehicle probe data 526 may be stored to permit the determination of vehicle speed at particular locations. Also, road data 530, such as data for generating maps and otherwise determining the locations of road segments in a system, may be made available to other components of information provider system 508. Finally, pair storage data 528 may include data for matched sensor readings between different types of sensors, such as explained above for FIG. 3A.

A processor (which may be a single processor or multiple processors) 514 in system 508 may process code for a variety of program modules. Four such modules are shown here as an example. A data matcher 520 accesses data points in the road sensor data 524 and the vehicle probe data 526, and identifies points that appear to match generally in location and time, so as to lead to an inference that the data points are for the same vehicle or at least for similar traffic conditions. The data matcher 520 may further combine multiple data points into a common group, or bucket, to make processing of the data less complex.

Data formatter 522 may perform various processing on the data stored in the databases 524-530. For example, data formatter 522 may compute supplemental data relating to data points received from sensors, such as by calculating paths between points reported by vehicle probes, and computing speeds of vehicles along such paths. Other formatting of data may also occur, such as to prepare the data into a form in which it may be analyzed by data matcher 520.

The alignment module 516 may be used to compute a transform to be applied to future data points by using past data points. For example, as described above, a transform may be applied to one type of sensor data by applying past readings from a second type of sensor to readings for the first type of sensor. Such a process may effectively calibrate the first type of sensor for various times and locations.

The data cleaning module 518 may be applied to future data received from a first type of sensor, and may impose the computed transform on such data. The transform may in effect apply the computed calibration to the various readings from the sensors. As a result, the readings from the sensors may provide more accurate real-time data regarding traffic flow.

Figure 6A:
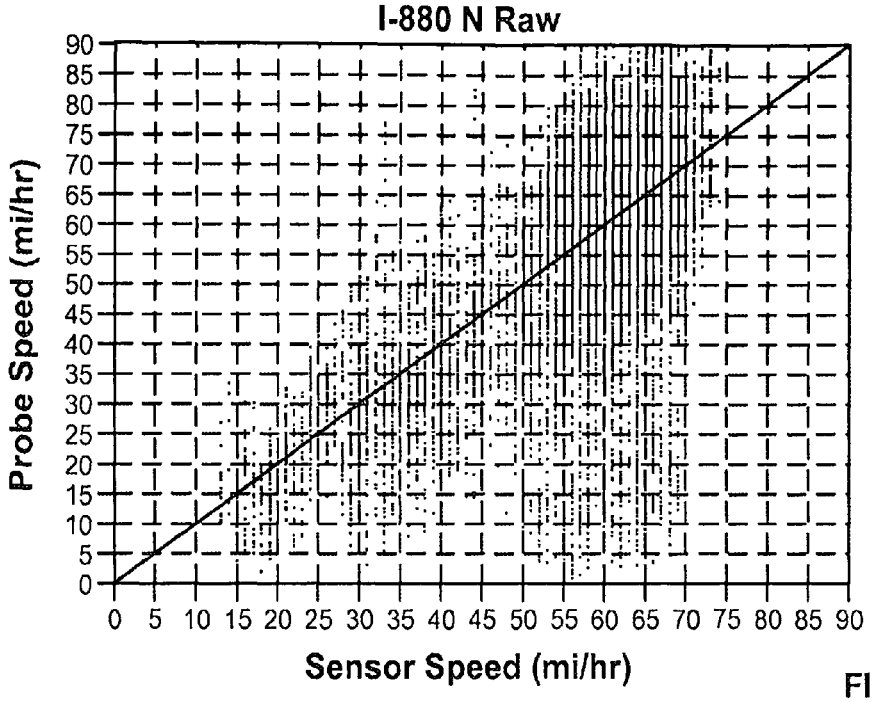
FIGS. 6A and 6B show correlations between traffic sensor speed and vehicle probe speed.
Figure 6B:
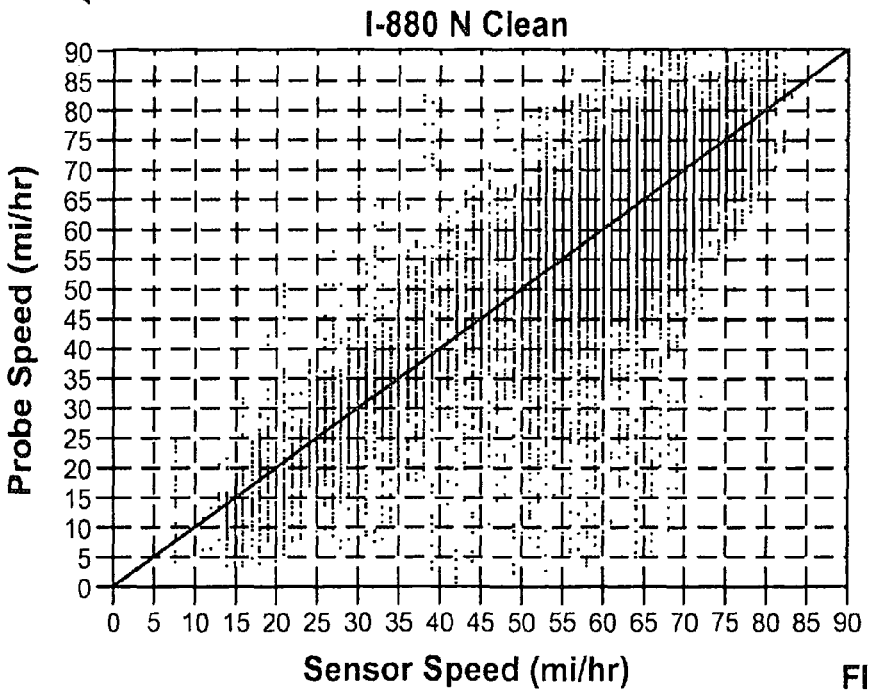

FIGS. 6A and 6B show correlations between traffic sensor speed and vehicle probe speed. FIG. 6A generally shows a correlation between points measured by sensors and corresponding data points measured by vehicle probes based on raw data that has not been cleaned. The x-axis shows speeds sensed by road sensors for particular events at particular times, while the y-axis shows corresponding speeds computed for vehicle probes. Perfect correlation between the two types of sensors is represented by the diagonal line across the graph in the figure, and represents equal speed readings for the two sensor types at a particular location (which should be the case if all sensors are accurate and are measuring the same event). Observation of the graph 60 shows that sensor speeds tend to be slightly higher than probe speeds, and that sensor speeds tend to cut off at 70-75 mph.

FIG. 6B generally shows the same set of data points, but after cleaning in a manner like that discussed above. The cleaning in this example occurred with a transform calculated using a Bayesian linear regression approach with a zero intercept prior. Observation of the graph 602 indicates that points in the lower right quadrant have been significantly reduced, so that the road sensors are no longer over-reporting speeds to such a significant degree.

FIGS. 7A-7D are maps of traffic speed on various roads across a period of time, under various processing conditions. The figures generally show a two-dimensional grid of shaded blocks or pixels, with the y-axis representing various road segments along Interstate 880 in the Silicon Valley, and the x-axis representing the time of day. Particular points (with waypoints and mile markers) are shown along the y-axis for reference to locations along the roadway.

The shading level of each block represents the speed of traffic at that road segment for the particular time. There are four shading levels in the example, with the darkest shade representing traffic speed of 0 miles per hour, the second darkest representing 30 miles per hour, the second lightest representing 60 miles per hour, and the lightest shade representing 90 miles per hour.

Figure 7A:
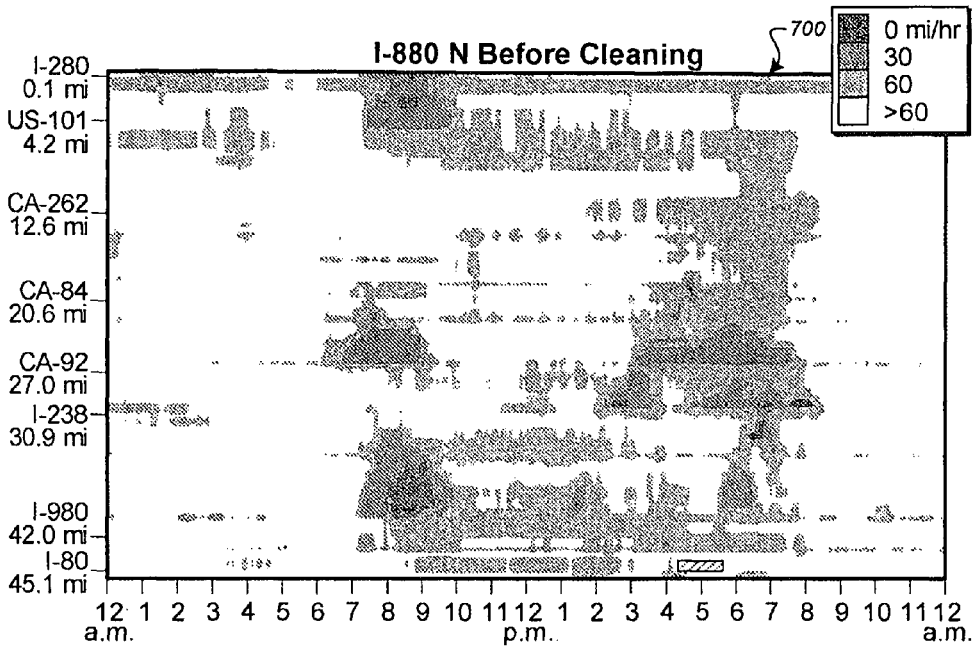
FIGS. 7A-7D are maps of traffic speed on various roads across a period of time, under various processing conditions.
Figure 7B:
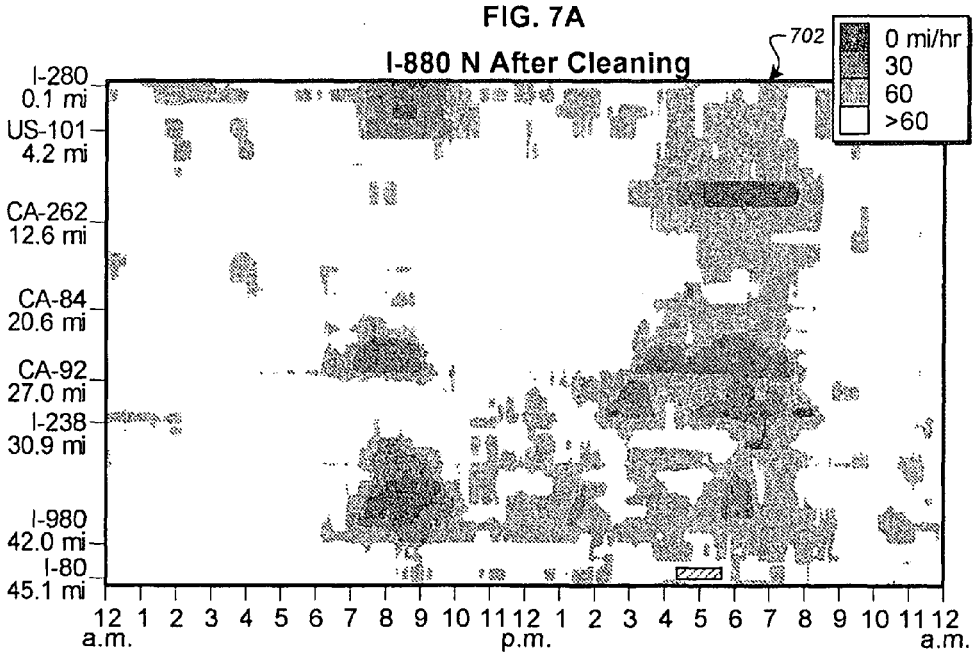

FIG. 7A represents raw road sensor data, while FIG. 7B represents raw data "cleaned" using a transform like those discussed above, and FIG. 7C further represents smoothing of the data with a learned kernel like that discussed above. The most noticeable feature of the graph in FIG. 7A is a lack of any indication of slowed afternoon traffic near the I-880 mile marker around 12.6 miles. The slowing of traffic at that area and time is reflected in vehicle probe data, so that the "cleaned" road sensor data reflects such a reality (FIG. 7B). The explanation may be that the road sensor at that location is broken or mis-calibrated.

Figure 7C:
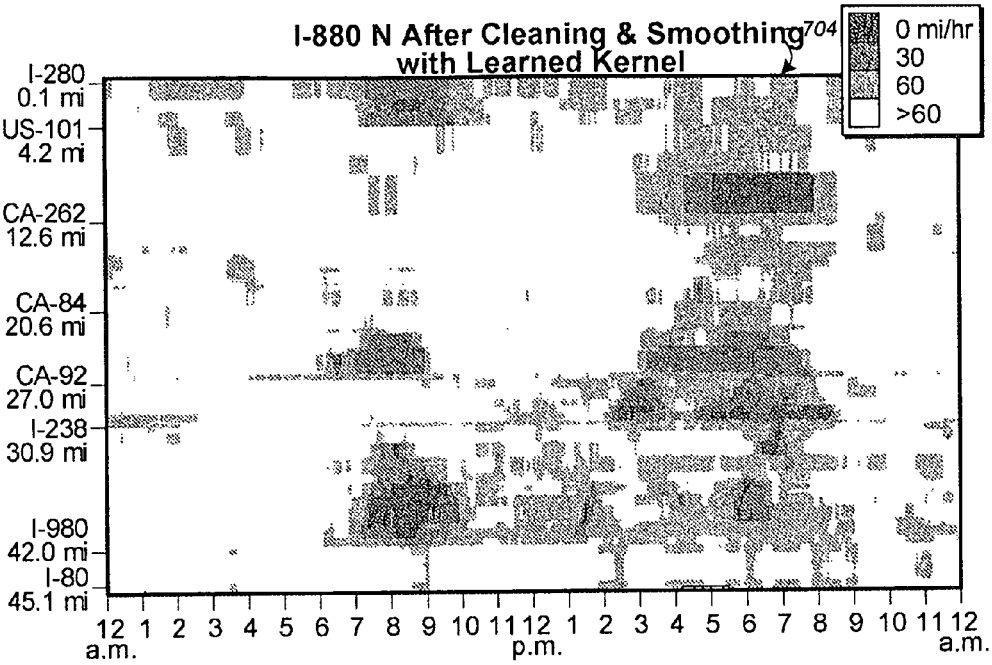

One noticeable difference between the graph 704 in FIG. 7C and graph 702 in FIG. 7B is the spreading of the slow area around the 12.6 mile marker up and down the road, which would seem to better reflect actual traffic conditions. The smoothing, in particular, may be used to better interpolate between road segments, and thus spreads the representation of the slow-down in traffic outward slightly.

Figure 7D:
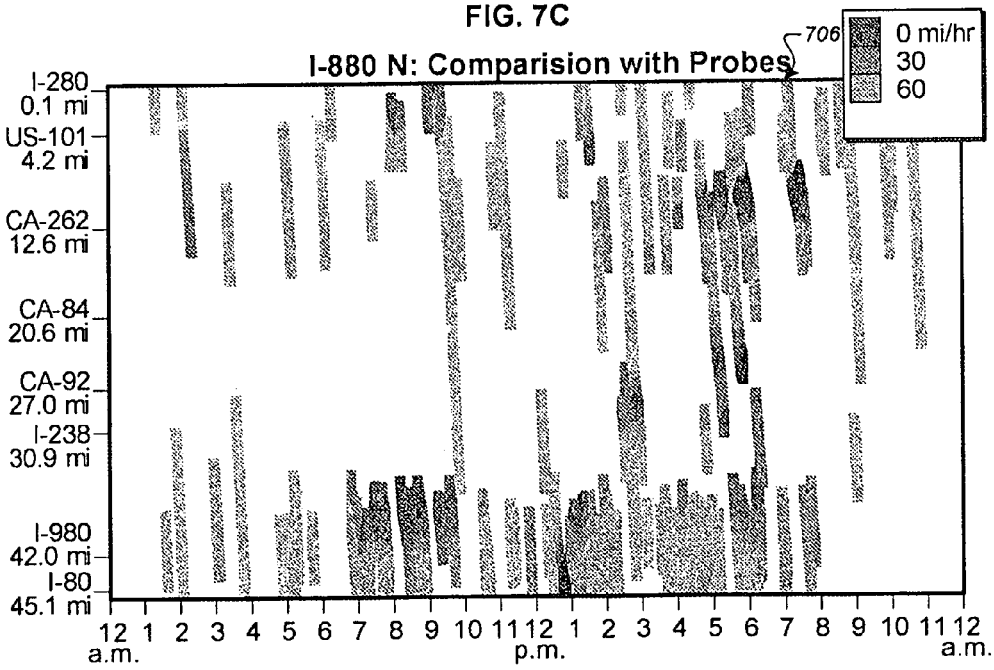

FIG. 7D shows particular sets of vehicle probe data for particular vehicles as they moves along the highway. The vehicle motion is shown as being from I-280 to I-80, as the data at the bottom is later-in-time (i.e., farther to the right) than the data at the top. Gaps in the data show a lack of location reporting by a mobile device. Observation of the figure shows traffic slowdowns sensed in the afternoon around the 12.6 mile marker as mentioned above. Such data, which was absent from the road sensor data, was used in this example to clean the road sensor data.

Figure 8:
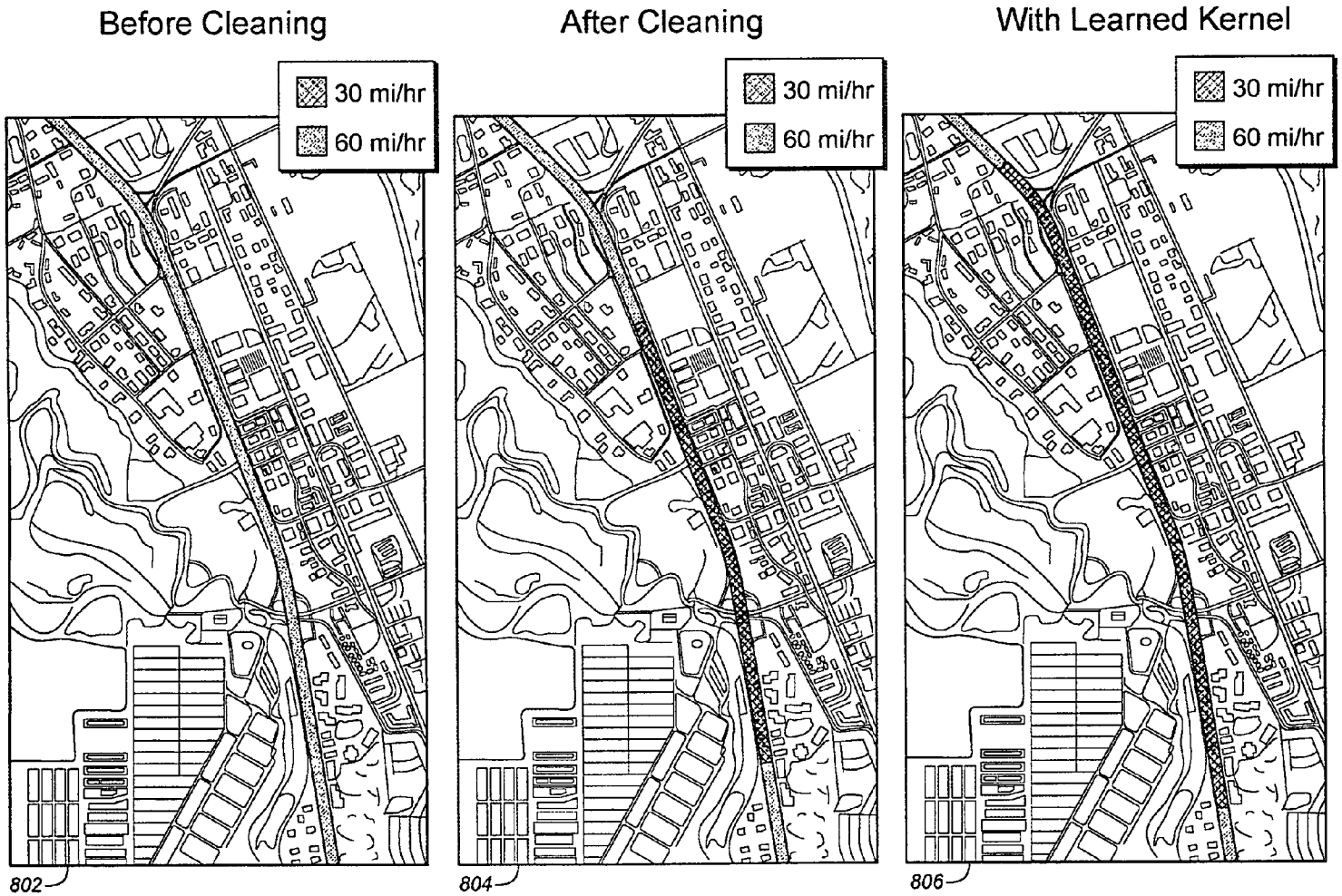
FIG. 8 shows a geographic map with overlaid traffic information for various processing conditions.

FIG. 8 shows a geographic map with overlaid traffic information for various processing conditions. The map is the sort of map that is commonly displayed on a navigation device, with mapping and/or satellite images, and colors representing traffic speed overlaid as lines on various roads. In this example, the road is I-880 at the Mission Boulevard Exit, with good traffic conditions (high-speed traffic flow) shown by light shading and bad traffic conditions (low-speed traffic flow) shown by darker shading.

As shown in image 802, raw road sensor data indicates that traffic is good all along the pictured route. After cleaning the road sensor data with vehicle probe data, the transformed road sensor data in image 804 shows an actual slowdown in a middle portion of the route. Presumably, this view of traffic is more accurate than is the view in image 802, because the vehicle probe data, though less comprehensive than the sensor data, generally provides a more diverse (i.e., readings from a number of different devices in different vehicles) and more accurate (i.e., solid state, modern, mass-produced GPS technology) picture. After smoothing, in image 806, the indication of the traffic slowdown spreads both North and South, indicating that traffic is not likely slowing down suddenly at the particular road sensor that is sensing (or under-sensing) the slowed traffic.

Figure 9:
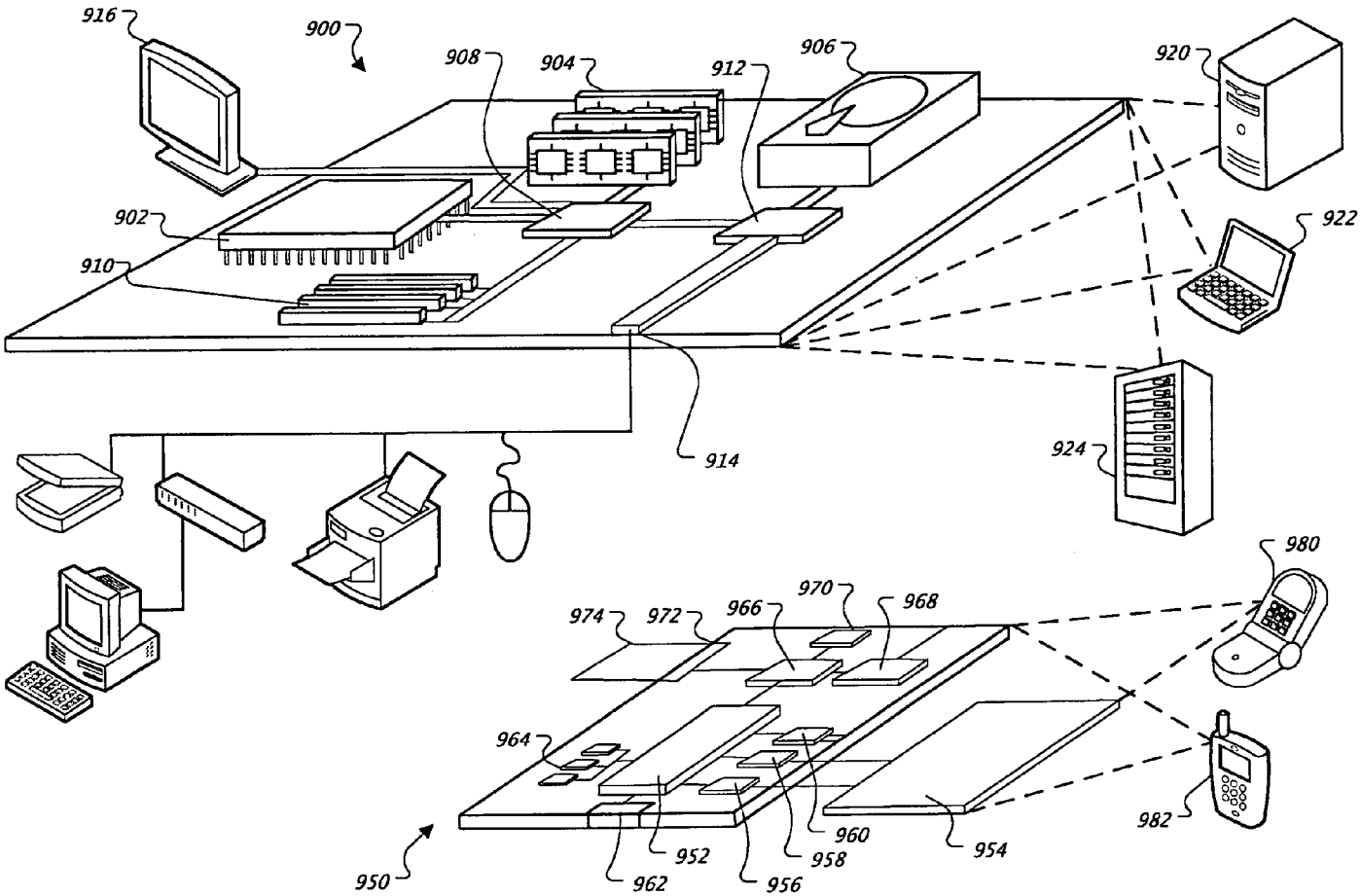
FIG. 9 shows an example of a computer device and a mobile computer device that can be used to implement the techniques described here.

FIG. 9 shows an example of a computer device 900 and a mobile computer device 950 that can be used to implement the techniques described here. Computing device 900 is intended to represent various forms of digital computers, such as laptops, desktops, workstations, personal digital assistants, servers, blade servers, mainframes, and other appropriate computers. Computing device 950 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 900 includes a processor 902, memory 904, a storage device 906, a high-speed interface 908 connecting to memory 904 and high-speed expansion ports 910, and a low speed interface 912 connecting to low speed bus 914 and storage device 906. Each of the components 902, 904, 906, 908, 910, and 912, are interconnected using various busses, and may be mounted on a common motherboard or in other manners as appropriate. The processor 902 can process instructions for execution within the computing device 900, including instructions stored in the memory 904 or on the storage device 906 to display graphical information for a GUI on an external input/output device, such as display 916 coupled to high speed interface 908. In other implementations, multiple processors and/or multiple buses may be used, as appropriate, along with multiple memories and types of memory. Also, multiple computing devices 900 may be connected, with each device providing portions of the necessary operations (e.g., as a server bank, a group of blade servers, or a multi-processor system).

The memory 904 stores information within the computing device 900. In one implementation, the memory 904 is a volatile memory unit or units. In another implementation, the memory 904 is a non-volatile memory unit or units. The memory 904 may also be another form of computer-readable medium, such as a magnetic or optical disk.

The storage device 906 is capable of providing mass storage for the computing device 900. In one implementation, the storage device 906 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 904, the storage device 906, memory on processor 902, or a propagated signal.

The high speed controller 908 manages bandwidth-intensive operations for the computing device 900, while the low speed controller 912 manages lower bandwidth-intensive operations. Such allocation of functions is exemplary only. In one implementation, the high-speed controller 908 is coupled to memory 904, display 916 (e.g., through a graphics processor or accelerator), and to high-speed expansion ports 910, which may accept various expansion cards (not shown). In the implementation, low-speed controller 912 is coupled to storage device 906 and low-speed expansion port 914. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 900 may be implemented in a number of different forms, as shown in the figure. For example, it may be implemented as a standard server 920, or multiple times in a group of such servers. It may also be implemented as part of a rack server system 924. In addition, it may be implemented in a personal computer such as a laptop computer 922. Alternatively, components from computing device 900 may be combined with other components in a mobile device (not shown), such as device 950. Each of such devices may contain one or more of computing device 900, 950, and an entire system may be made up of multiple computing devices 900, 950 communicating with each other.

Computing device 950 includes a processor 952, memory 964, an input/output device such as a display 954, a communication interface 966, and a transceiver 968, among other components. The device 950 may also be provided with a storage device, such as a microdrive or other device, to provide additional storage. Each of the components 950, 952, 964, 954, 966, and 968, are interconnected using various buses, and several of the components may be mounted on a common motherboard or in other manners as appropriate.

The processor 952 can execute instructions within the computing device 950, including instructions stored in the memory 964. The processor may be implemented as a chipset of chips that include separate and multiple analog and digital processors. The processor may provide, for example, for coordination of the other components of the device 950, such as control of user interfaces, applications run by device 950, and wireless communication by device 950.

Processor 952 may communicate with a user through control interface 958 and display interface 956 coupled to a display 954. The display 954 may be, for example, a TFT LCD (Thin-Film-Transistor Liquid Crystal Display) display or an OLED (Organic Light Emitting Diode) display, or other appropriate display technology. The display interface 956 may comprise appropriate circuitry for driving the display 954 to present graphical and other information to a user. The control interface 958 may receive commands from a user and convert them for submission to the processor 952. In addition, an external interface 962 may be provide in communication with processor 952, so as to enable near area communication of device 950 with other devices. External interface 962 may provide, for example, for wired communication in some implementations, or for wireless communication in other implementations, and multiple interfaces may also be used.

The memory 964 stores information within the computing device 950. The memory 964 can be implemented as one or more of a computer-readable medium or media, a volatile memory unit or units, or a non-volatile memory unit or units. Expansion memory 974 may also be provided and connected to device 950 through expansion interface 972, which may include, for example, a SIMM (Single In Line Memory Module) card interface. Such expansion memory 974 may provide extra storage space for device 950, or may also store applications or other information for device 950. Specifically, expansion memory 974 may include instructions to carry out or supplement the processes described above, and may include secure information also. Thus, for example, expansion memory 974 may be provide as a security module for device 950, and may be programmed with instructions that permit secure use of device 950. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 964, expansion memory 974, memory on processor 952, or a propagated signal that may be received, for example, over transceiver 968 or external interface 962.

Device 950 may communicate wirelessly through communication interface 966, which may include digital signal processing circuitry where necessary. Communication interface 966 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 968. In addition, short-range communication may occur, such as using a Bluetooth, WiFi, or other such transceiver (not shown). In addition, GPS (Global Positioning System) receiver module 970 may provide additional navigation- and location-related wireless data to device 950, which may be used as appropriate by applications running on device 950.

Device 950 may also communicate audibly using audio codec 960, which may receive spoken information from a user and convert it to usable digital information. Audio codec 960 may likewise generate audible sound for a user, such as through a speaker, e.g., in a handset of device 950. Such sound may include sound from voice telephone calls, may include recorded sound (e.g., voice messages, music files, etc.) and may also include sound generated by applications operating on device 950.

The computing device 950 may be implemented in a number of different forms, as shown in the figure. For example, it may be implemented as a cellular telephone 980. It may also be implemented as part of a smartphone 982, personal digital assistant, or other similar mobile device.

Figure 10:
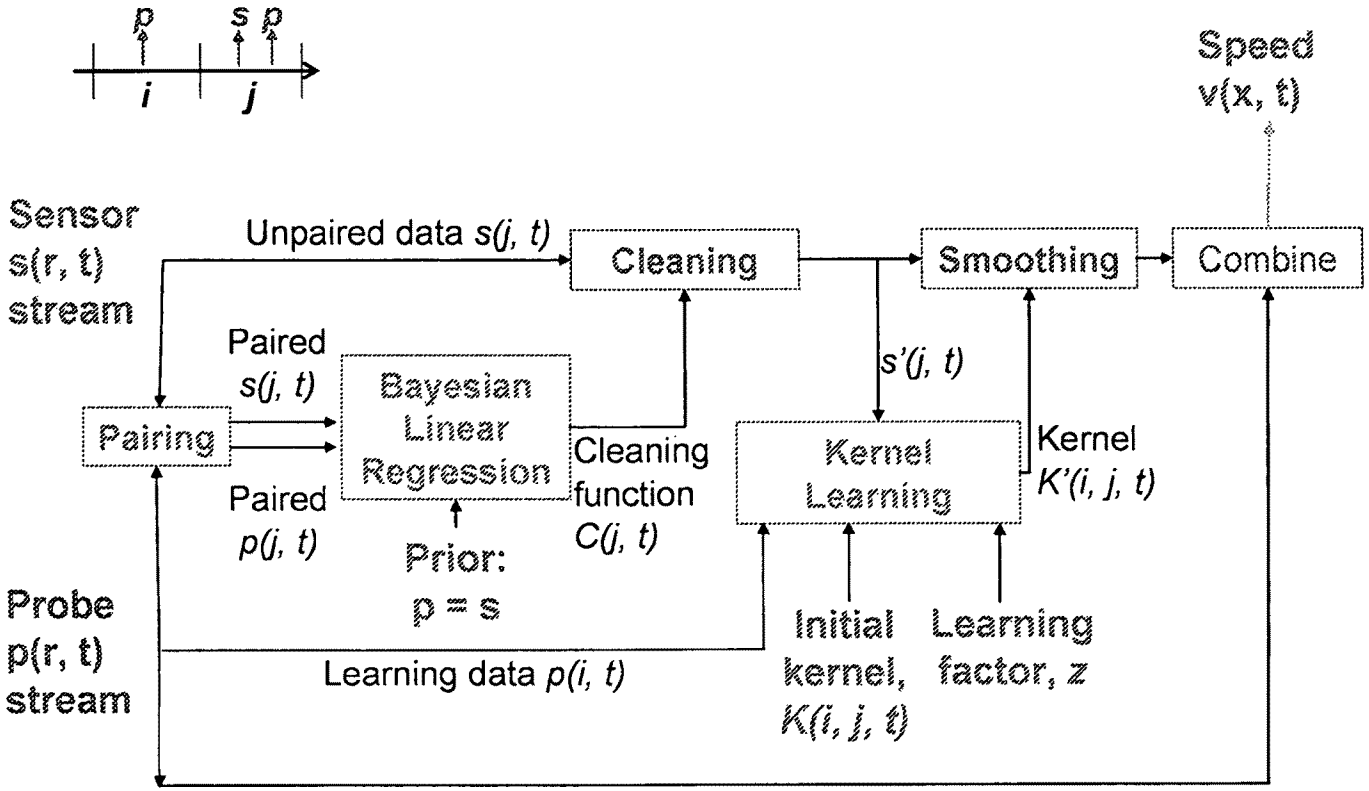
FIG. 10 shows a schematic diagram of a processing pipeline for cleaning sensor data.

FIG. 10 shows a schematic diagram of a processing pipeline for cleaning sensor data. At the left edge, uncorrected sensor data is provided to the process for pairing of the data from different types of sensors (e.g., identifying readings at approximately the same location at approximately the same time). The paired data is then passed to a linear regression process, such as a Bayesian linear regression process with an input prior as described above. The road sensor data may likewise be provided as a data stream to a cleaning process that may apply to the stream a cleaning function derived form the linear regression.

The cleaned road sensor data may then be applied to a smoothing process. The smoothing process may additionally receive input from a kernel learning process like that described above. The kernel learning process may be loaded with an initial kernel, and may also be provided a learning factor. The other input for the kernel learning process may be learning data, such as vehicle probe data, along with cleaned road sensor data. The output of the kernel learning process may then be supplied to the smoothing process, whose output may in turn be combined with vehicle probe data to produce an indication of speed for a particular location at a particular time.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the inventive concepts disclosed herein. For example, various mechanisms for obtaining traffic data may be used, and various mechanisms for reporting traffic conditions to users may also be employed. In addition, various manners for cleaning or adjusting the data from certain sensors may be used. As one example, information indicating a difference between a road sensor and vehicle probe sensors can be fed back to an organization that operates the road sensors. The operating organization may thus more readily identify defective or miscalibrated sensors. Such sharing of information may create a sort of symbiosis between that operating organization and a information provider that uses data from the operating organization—a symbiosis that may permit the operating organization to provide better service or to lower its prices for supplying data. The operating organization may likewise notify the information provider when it alters a sensor, such as by repairing it, so that the information provider can "reset" its data on that sensor. Alternatively, or in addition, the information provider may recognize such changes in a sensor by a step function change in the output of the sensor or the difference between the sensor and readings from other sensors, and may adjust its data processing in a like manner.

In addition, although use of two sources of data, with application of one source to another source, to generate a transform for the other source, is shown, more than two sources may also be used. Generally, such an approach may be successfully conducted if one of the sources can safely be assumed to be accurate, or a ground truth.

In addition, although certain cleaning and smoothing approaches are described above, others may also be employed. For example, regular linear regression may be used, various kernels (e.g., Gaussian) may be employed, and different forms of learning may be used (e.g., taking into account speed variance in addition to error-weighted modification). In addition, although cleaning and smoothing are described above as two separate actions, they could be combined into a single step. Moreover, the order of various operations discussed above may be changed, and multiple operations may be combined into a single operation, while a single operation may be split into multiple operations.

In addition, although relatively even computation is implied above, e.g., processing for every sensor/time pair, various other approaches may also be used. For example, the processing for some sensors may not vary much across a day, so computation and storage overhead could be reduced during such times by reusing the processing for multiple time-of-day buckets. Alternatively, or in addition, the processing function for a time of day may be determined, and then a function that captures how the first function varies over time may also be determined.

Accordingly, other embodiments are within the scope of the following claims.

What is claimed is:

1. A computer-implemented method, comprising:

obtaining a plurality of sensor data pairs from a stationary road sensor disposed at a first location along a road segment, each of the sensor data pairs comprising a traffic speed value that reflects speed, at the first location, of actual traffic on the road segment and a traffic speed time at which the corresponding traffic speed value was captured;

obtaining a plurality of probe data sets from one or more moving probes, each of the probe data sets comprising a probe speed value for a probe traveling along the road segment, a location indicator specifying a probe location along the road segment for which the probe speed value was determined, and a time indicator specifying a time for which the probe speed value was determined;

matching one or more sensor data pairs from the stationary road sensor to one or more probe data sets from the one or more moving probes;

performing, by a processor, regression analysis on the matched one or more sensor data pairs and one or more probe data sets to determine a transform to apply to the traffic speed values obtained from the road sensor, the regression analysis comprising comparison of data derived from the stationary road sensor and data derived from the one or more moving probes; and applying the transform to at least one traffic speed value obtained from the stationary road sensor to provide an updated traffic speed value that differs from an initial traffic speed value obtained from the stationary road sensor, and providing the updated traffic speed value as a value that represents traffic speed in a vicinity of the stationary road sensor.

2. The method of claim 1, wherein the one or more probes comprise a communication or navigation system outfitted in a vehicle traveling along the road segment.

3. The method of claim 1, wherein the one or more probes comprise a probe vehicle.

4. The method of claim 1, wherein the one or more moving probes comprise a mobile device carried by a user in a vehicle traveling along the road segment.

5. The method of claim 1, wherein performing regression analysis comprises performing Bayesian linear regression analysis.

6. The method of claim 5, wherein performing Bayesian linear regression analysis comprises performing Bayesian linear regression analysis with a strong prior that favors a solution of vehicle speed value=traffic speed value+0.

7. The method of claim 1, wherein matching comprises identifying a probe data set whose location indicator specifies a probe location within a threshold distance of the first location and whose time indicator specifies a time that is within a threshold period of the traffic speed time.

8. The method of claim 7, further comprising forming a group of multiple matched sensor data pairs and probe data sets, wherein performing regression analysis comprises performing regression analysis on the group.

9. The method of claim 8, wherein forming the group comprises forming the group based on a time of day to which the traffic speed times in the sensor data pairs and the time indicators in the matched probe data sets correspond.

10. The method of claim 9, wherein the time of day is characterized by a period of time that is longer than the threshold period.

11. The method of claim 1, further comprising:

obtaining other pluralities of sensor data pairs from other stationary road sensors disposed at locations other than the first location along the road segment;

matching other probe data sets with other sensor data pairs received from the other pluralities; and performing linear regression analysis on the matched other probe data sets and other sensor data pairs to determine other transforms to apply to traffic speed values obtained from each of the other stationary road sensors.

12. The method of claim 11, wherein the road sensor and other road sensors provide superior coverage of the road segment but inferior accuracy in traffic speed values, and the one or more probes provide superior accuracy in vehicle speed values but inferior coverage of the road segment.

13. The method of claim 11, wherein performing regression analysis comprises performing regression analysis at a first period of time; and applying the transform comprises applying the transform at a second period of time that is subsequent to the first period of time and in substantially real time to obtaining the at least one traffic speed value from the road sensor.

14. The method of claim 13, further comprising receiving a request for a current traffic speed value at the first location and subsequently providing, in real time, the updated traffic speed value.

15. One or more devices having tangible, computer readable media storing instructions that, when executed by one or more computer processors, perform operations comprising:

obtaining a plurality of sensor data pairs from a stationary road sensor disposed at a first location along a road segment, each of the sensor data pairs comprising a traffic speed value that reflects speed, at the first location, of actual traffic on the road segment and a traffic speed time at which the corresponding traffic speed value was captured;

obtaining a plurality of probe data sets from one or more moving probes, each of the probe data sets comprising a probe speed value for a probe traveling along the road segment, a location indicator specifying a probe location along the road segment for which the probe speed value was determined, and a time indicator specifying a time for which the probe speed value was determined;

matching one or more sensor data pairs from the stationary road sensor to one or more probe data sets from the one or more moving probes;

performing regression analysis on the matched one or more sensor data pairs and one or more probe data sets to determine a transform to apply to the traffic speed values obtained from the road sensor, the regression analysis comprising comparison of data derived from the stationary road sensor and data derived from the one or more moving probes; and applying the transform to at least one traffic speed value obtained from the stationary road sensor to provide an updated traffic speed value that differs from an initial traffic speed value obtained from the stationary road sensor, and providing the updated traffic speed value as a value that represents traffic speed in a vicinity of the stationary road sensor.

16. The one or more devices of claim 15, wherein the one or more probes comprise a communication or navigation system outfitted in a vehicle traveling along the road segment.

17. The one or more devices of claim 15, wherein the one or more moving probes comprise a mobile device carried by a user in a vehicle traveling along the road segment.

18. The one or more devices of claim 15, wherein performing regression analysis comprises performing Bayesian linear regression analysis with a strong prior that favors a solution of vehicle speed value=traffic speed value+0.

19. The one or more devices of claim 15, wherein performing regression analysis comprises performing regression analysis at a first period of time; and applying the transform comprises applying the transform at a second period of time that is subsequent to the first period of time and in substantially real time to obtaining the at least one traffic speed value from the road sensor.

20. The one or more devices of claim 15, further comprising receiving a request for a current traffic speed value at the first location and subsequently providing, in real time, the updated traffic speed value.

* * * * *